United States Patent [19]

Steers et al.

[11] 4,400,838

[45] Aug. 30, 1983

[54] METHOD OF DETERMINING THE AVERAGE NATURE OF THE MATERIALS OF THE LAUNDRY IN A LAUNDRY WASHING MACHINE AND WASHING MACHINE EMPLOYING SAID METHOD

[75] Inventors: Michel Steers, Chennevieres-sur-Marne; Jean-Pierre Hazan, Sucy-en-Brie, both of France

[73] Assignee: U.S. Philips Corporation, New York, N.Y.

[21] Appl. No.: 271,302

[22] Filed: Jun. 8, 1981

[30] Foreign Application Priority Data

Jun. 13, 1980 [FR] France ..... 80 13202

[51] Int. Cl.[3] ..... D06F 33/02

[52] U.S. Cl. ..... 8/158; 68/12 R

[58] Field of Search ..... 8/158; 68/12 R

[56] References Cited

U.S. PATENT DOCUMENTS 4,303,406 12/1981 Ross ..... 68/12 R X

FOREIGN PATENT DOCUMENTS 2920492 12/1979 Fed. Rep. of Germany ..... 68/12 R

*Primary Examiner*—Philip R. Coe

*Attorney, Agent, or Firm*—James J. Cannon, Jr.

[57] ABSTRACT

A method of determining the average nature of the materials of a laundry in a laundry washing machine including measuring the weight of the laundry loaded into the machine, detecting the volume and the level of water admitted to the tub of the machine, determining the volume of water absorbed per unit of weight of the laundry and from these factors determining the nature of the materials in the laundry for a determination of the specific treatment and washing operation for such materials. A laundry washing machine with sensors and circuitry to carry out the method is also disclosed.

6 Claims, 3 Drawing Figures

METHOD OF DETERMINING THE AVERAGE NATURE OF THE MATERIALS OF THE LAUNDRY IN A LAUNDRY WASHING MACHINE AND WASHING MACHINE EMPLOYING SAID METHOD

BACKGROUND OF THE INVENTION

Field of the Invention

The invention relates to a method of determining the average nature of the materials of the laundry in a laundry washing machine, which method comprises the measurement of the weight of the laundry loaded into the machine, the detection of the volume (V) and the detection of the level (h) of the water admitted to the tub of the machine.

It is important that the nature of the laundry in a washing machine is known, because the specific treatments and washing operations to which said laundry is to be subjected depend on said nature and because an incorrect treatment may be detrimental to said laundry.

SUMMARY OF THE INVENTION

It is an object of the present invention to provide a method of determining the average nature of the laundry in the machine by electronic means, in order to ensure that the appropriate treatment is applied to laundry of a specific nature.

According to the invention the method is characterized in that at least one of said detections is effected continuously during filling of the tub, that the detected level (h) is compared with at least one reference value, and that when the water level in the tub begins to exceed said reference value the machine determines the nature of the laundry in the tub by comparing the volume of water absorbed per unit of weight of the laundry with a series of typical absorbed values each corresponding to laundry of a specific nature. Thus, by the use of the water-absorption properties of the laundry, which properties influence the water level reached in the tub for a given volume of water admitted to the tub, it is possible to determine the average nature of the materials of the laundry in the tub.

DESCRIPTION OF THE PRIOR ART

It is to be noted that the water-absorption properties of laundry have been used for a different purpose, which is specifically known from German Patent Application No. 29 40 492. Said Application describes a method of controlling a washing machine of the economy type. In accordance with said method the weight of the laundry loaded into the machine is measured. Subsequently, the tub is filled up to a level which is computed starting from the weight and the washing programme selected by the user. When the tub is being filled with water, the water-absorbing capacity of the laundry is determined from the difference between the water level corresponding to the volume of water admitted and the actual level that is reached. Depending on the absorption capacity and the weight of the laundry the water levels for washing and rinsing are determined in order to avoid a waste of water. An indication of the nature of the laundry is given by the user by means of a selection button on the machine. An erroneous selection may therefore result in an incorrect treatment of the laundry.

In order to exclude such human errors the nature of the laundry is therefore determined by the machine itself.

The method in accordance with the invention is specifically characterized in that the volume of water absorbed per unit of weight of the laundry is compared with three typical values, which typical values correspond to three curves representing the level (h) of the water in the tub as a function of the volume (V) of the water, which three curves are a first curve corresponding to the absence of laundry in the machine, a second curve corresponding to the presence of laundry of an absorbent material, and a third curve corresponding to the presence of laundry of a material which is little or not absorbent. In each of these cases the nature of the laundry follows from the geometrical differences of the curves which represent the variation of the water level h in the tub as a function of the volume V of the water admitted in Cartesian coordinates. Specifically, if the tissue is highly absorbent, for example in the case of woolens or cotton, and water is admitted, the water is initially absorbed by the laundry in proportion to the weight of the load of laundry, so that it takes more time until a constant water level is reached. The curve representing the water level has a function of the volume V will exhibit a plateau parallel to the horizontal axis, the length of said plateau, which is equal to the volume of water absorbed, being characteristic of the presence of woolens and their weight. Conversely, in the case of laundry which is little absorbent, for example synthetic materials, the corresponding curve will not exhibit a plateau and will very closely approximate the theoretical curve (without laundry), which is typical of said synthetic materials.

The method in accordance with the invention is especially characterized in that said reference value corresponds to the length of a plateau of said second curve, which plateau is substantially parallel to the volume axis. The choice of the plateau of the second curve as reference value is advantageous because the presence of a plateau indicates the presence of absorbent materials in the tub of the washing machine, which materials will prevent the water level in the tub from rising.

Suitably, the method in accordance with the invention is characterized in that during filling of the tub initially a sequence of alternate periods occur in which the drum of the machine is stationary and rotates respectively, which sequence continues until an indication that the water level has a constant mean value as a function of time disappears. This is because allowance should be made for the rate of water absorption by the laundry, which may retard the formation of the plateau. If simultaneously with the start and stop periods of the drum the water supply to the tub comprises a sequence of off and on periods, the instantaneous water level in the tub will oscillate about a mean value which corresponds to the plateau.

The invention also relates to a laundry washing machine employing the method in accordance with the invention, which machine comprises a device for measuring the weight of the laundry loaded into the machine and electronic means for storage of the laundry-weight value.

In accordance with the invention a machine employing the method is characterized in that it comprises a device for continuously measuring the volume of water admitted to the tub and a device for continuously measuring the water level, a device for determining the volume of water absorbed per unit of laundry weight having a first input connected to the device for continuously measuring the volume of water and a second input connected to the electronic means for the storage of the laundry-weight value, which device has an output connected to a device for identifying the average nature of the materials of the laundry in the tub. In the laundry identification device the value of the volume of water absorbed per unit of weight is compared with typical values in order to determine the average nature of the laundry.

Advantageously a washing machine in accordance with the invention comprising a "volume" memory for storing the value of the volume of water admitted to the machine and is characterized in that it also comprises a first comparator block for comparing the measured water level with a reference level and for generating a validation signal when the measured level exceeds the reference level, which validation signal is applied to the "volume" memory, a divider block, having a first input connected to the "volume" memory and a second input to the electronic means for the storage of the laundry-weight value, for determining the quotient of the value of the volume of water in the tub and the value of the laundry weight upon receipt of the validation signal, which divider block has an output connected to a second comparator block for comparing the quotient signal on the output of the divider block with typical quotients of the volume of water absorbed per unit of weight of various known types of laundry.

In this way the method in accordance with the invention can be utilized in a washing machine in a cheap and simple manner.

The invention employs the information received for controlling the washing programme selection devices depending on the nature of the laundry to be washed and the quantity of laundry present in the machine, which devices form part of the machine.

BRIEF DESCRIPTION OF THE DRAWINGS

The invention will be more fully understood by means of the following description with reference to the accompanying drawings, of which.

DESCRIPTION OF THE PREFERRED EMBODIMENT

When considering, for example, the case in which the tub of a washing machine is substantially a cylinder of circular cross-section with a radius R and whose horizontal axis has a length L, the value V of water in the tub in the absence of laundry is related to the water level h in said tub by the expression:

$$V=L[R^2 \text{ arc sin } (2Rh-h^2)^{\frac{1}{2}}/R-(R-h)\,(2Rh-h^2)^{\frac{1}{2}}]$$

Figure 1:
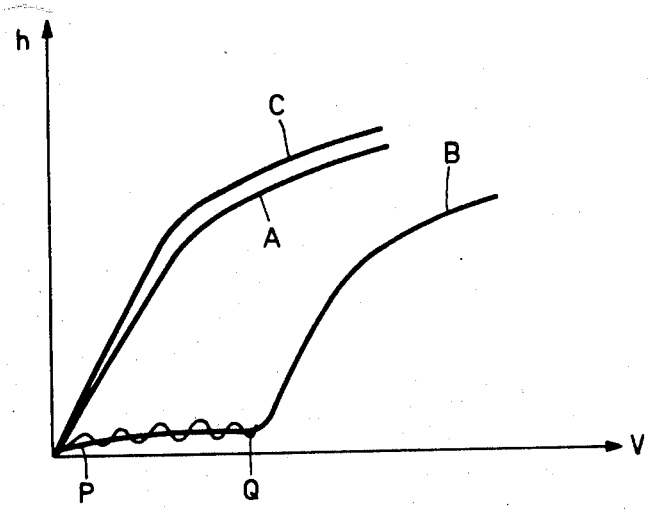
FIG. 1 represents curves which serve to explain the method.

The curve A of FIG. 1 represents the variation of h as a function of V in accordance with this expression. This curve is determined, in accordance with the inventive method, in the absence of laundry by continuously and simultaneously measuring the water level h in the tub and/or the volume of water admitted to the machine during filling of the tub of the machine. Now it is assumed that filling takes place while absorbent laundry, for example woolens, is present. Inherently absorption proceeds with a certain delay. It is promoted by stirring the laundry in the water. In order to promote said absorption, filling of the tub, in accordance with the invention, is initially effected with a sequence of on and off-periods of the water supply to the machine, the off-periods being utilized for stirring the laundry by rotating the rotary drum containing the laundry during each off-period. Owing to said absorption and the periodic stirring of the laundry in the water the water level h in the tub tends to remain low at the beginning of the filling operation and to oscillate about a substantially constant mean value. Laundry stirring is discontinued when the absorption capacity of the laundry is exhausted and when it is found that the water level tends to rise like in the absence of laundry. The curve giving the variation of h as function of V is then the curve of type B situated below A. This curve initially exhibits oscillations of the level h of a substantially constant mean value corresponding to the laundry-stirring period during absorption, said mean value being the ordinate of the plateau PQ, followed by a rising portion. The length of the plateau PQ increases as the amount of laundry or the weight of the laundry increases. For a given weight of laundry said length is characteristic of the nature of the laundry and is proportional to the weight of the laundry. In accordance with the inventive method the length of said plateau PQ, is measured in order to determine the nature of the laundry if the weight of the load of laundry in the machine is known, or in order to determine the weight of the laundry in the machine if the nature of the laundry is known. It is now assumed that filling takes place when a load of laundry is present which is substantially non-absorbent or rather which absorbs an amount of water smaller than its own weight, which corresponds to laundry of a synthetic material. The curve found for h as a function of V is then of type C, close to the curve A, and is generally situated above it as a result of the Archimedes pressure exerted on the laundry. Thus, the measurement of said curve in accordance with the method provides a means of recognizing laundry of a synthetic material.

The method is utilized in washing machines. For this purpose the washing machine is equipped with a volume counter for measuring the water volume V, a device for the continuous measurement of the level h, for example of the type described in the applicant's French Patent Application No. 80 13 201, filed on June 13, 1980, and electronic means for storing the value of the volume of water admitted to the machine and for determining the volume of water absorbed per unit of laundry weight. The level detection device, in accordance with the aforementioned Application, is constituted by electrically insulated conductor, in the form of an arc of circle arranged in a cross-sectional plane common to the tub and the drum in the lower part of the tub, the circle having a radius intermediate between that of the tub and that of the drum and being centered relative to the common axis of the tub and the drum. Furthermore, the weight of the laundry is measured by measuring the variation of the weight of the machine owing to the laundry loaded into the machine. Means which may be utilized is an electrical resistance strain-gauge arranged between the chassis of the machine and the floor on which the machine rests.

Figure 2:
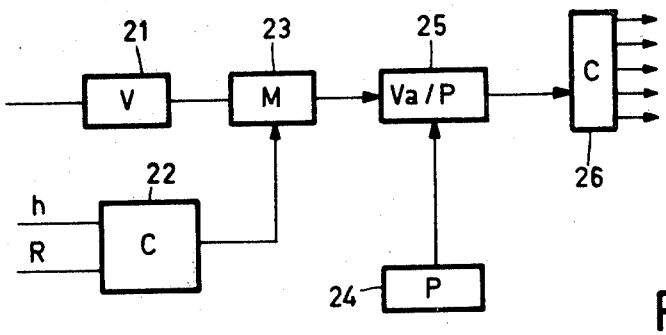
FIG. 2 represents a block diagram of the electronic means for carrying out the method.
Figure 3:
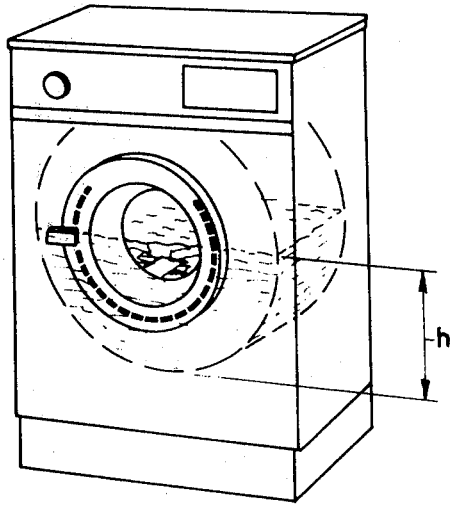
FIG. 3 represents a washing machine for carrying out the method.

In FIG. 2, which by way of example gives a block diagram of the electronic means, enabling the use of the method in the machine, the block 21 represents the counter with which the volume V of the water admitted to the machine is converted into an electric output signal proportional to said volume and the block 22 represents a comparator which receives the signal for the water level h from the level detector and a reference signal R, which corresponds to the water-absorption level of the plateau PQ represented in FIG. 1. Said comparator supplies a signal as soon as the water level h exceeds the reference level. Said signal supplied by the comparator is applied to the memory 23, which also receives the signal of the water flow counter. The memory then stores the value representing the volume of water admitted to the machine, which corresponds to the volume $V_a$ of water absorbed by the laundry (abscissa of point Q in FIG. 1). The information from the memory is applied to the divider block 25 and so is the information concerning the weight of dry laundry p received from the block 24. The block 25 computes the quotient $V_a/P$ of the volume $V_1$ of absorbed water and said weight P. Said quotient is applied to the comparator block 26 together with typical quotient values relating to the laundry of a specific nature. The quotient from 15 is compared with said different typical value in order to determine the nature of the laundry present in the machine. Thus, information relating to the nature of the laundry to be washed and the weight of said laundry is available in the machine.

The machine employs said information to control washing-program selection devices as a function of the nature of the laundry to be washed and the amount of laundry contained in the machine, which devices form part of the machine.

What is claimed is:

1. In a laundry washing machine which includes a memory, a method for determining the average nature of the materials of the laundry loaded into the tub of said machine, said method comprising the steps of:

measuring the weight of the laundry loaded into said tub;

filling said tub with water;

detecting the volume (V) and detecting the level (h) of the water admitted to said tub, at least one of the detections being effected continuously during said filling;

checking if said detected level (h) begins to exceed at least a first reference value, and generating a command signal if said detected level (h) begins to exceed said first reference value;

recording under control of said command signal the momentary volume (Va) of the water admitted into said tub;

determining, on the basis of said momentary volume (Va) and said weight, the volume of the water absorbed per unit of weight of the laundry;

determining the average nature of the materials of the laundry by comparing said volume of the water absorbed per unit of weight of the laundry with a series of typical absorbed water absorption values stored in said memory, each of said typical absorbed water absorption values corresponding to a laundry of a specific nature.

2. A method as claimed in claim 1, wherein the step of determining the average nature of material of the laundry is effected by comparing the volume of water absorbed per unit of weight of the laundry with three typical values, which typical values correspond to three curves representing the level (h) of the water in the tub as a function of the volume (V) of the water, which three curves are a first curve corresponding to the absence of laundry in the machine, a second curve corresponding to the presence of laundry of an absorbent material, and a third curve corresponding to the presence of laundry of a material which is little or not absorbent.

3. A method as claimed in claim 2, characterized in that said reference value corresponds to the level of a plateau of said second curve, which plateau is substantially parallel to the volume axis.

4. A method as claimed in claim 1 or 2 or 3 further including the steps of:

interrupting the filling of said tub;

rotating said tub during the period when said filling is interrupted:

resuming the filling of said tub;

repeating said steps of interrupting, rotating and resuming the filling until an indication that the water level has a constant mean value as a function of time disappears.

5. A washing machine employing a method for determining the average nature of materials of the laundry in a laundry washing machine, comprising:

a device for measuring the weight of the laundry loaded into the machine;

electronic means for storage of the laundry-weight value;

a device for continuously measuring the volume of water admitted to the tub; and a device for continuously measuring the water level in said tub;

a device for determining the volume of water absorbed per unit of laundry weight having a first input connected to the device for continuously measuring the volume of water and a second input connected to the electronic means for the storage of the laundry-weight value, which device has an output connected to a device for identifying the average nature of the materials of the laundry in the tub.

6. A washing machine as claimed in claim 5, which machine further includes a volume memory for storing the value of the volume of water admitted to the machine, characterized in that the machine also includes:

a first comparator block for comparing the measured water level with a reference level and for generating a validation signal when the measured level exceeds the reference level, which validation signal is applied to the volume memory;

a divider block having a first input connected to the volume memory and a second input to the electronic means for the storage of the laundry-weight, for determining the quotient of the value of the volume of water in the tub and the value of the laundry weight upon receipt of the validation signal; and which divider block has an output connected to a second comparator block (26) for comparaing the quotient signal on the output of the divider block with typical quotients of the volume of water absorbed per unit of weight of various known types of laundry.

* * * * *